US011342652B2

(12) United States Patent
Zhao

(10) Patent No.: US 11,342,652 B2
(45) Date of Patent: May 24, 2022

(54) 5G MMW DUAL-POLARIZED ANTENNA UNIT, ANTENNA ARRAY AND TERMINAL DEVICE

(71) Applicant: SHENZHEN SUNWAY COMMUNICATION CO., LTD., Guangdong (CN)

(72) Inventor: Yue Zhao, Shenzhen (CN)

(73) Assignee: SHENZHEN SUNWAY COMMUNICATION CO., LTD., Shenzhen (CN)

( * ) Notice: Subject to any disclaimer, the term of this patent is extended or adjusted under 35 U.S.C. 154(b) by 17 days.

(21) Appl. No.: 17/098,640

(22) Filed: Nov. 16, 2020

(65) Prior Publication Data

US 2022/0013884 A1 Jan. 13, 2022

Related U.S. Application Data

(63) Continuation of application No. PCT/CN2020/123515, filed on Oct. 26, 2020.

(30) Foreign Application Priority Data

Jul. 7, 2020 (CN) ..... 202010643740.2

(51) Int. Cl.

| | |
|---|---|
| ***H01Q 21/24*** | (2006.01) |
| ***H01Q 1/24*** | (2006.01) |
| ***H01Q 21/06*** | (2006.01) |
| ***H01Q 9/04*** | (2006.01) |

(52) U.S. Cl.
CPC ..... *H01Q 1/243* (2013.01); *H01Q 9/0421* (2013.01); *H01Q 21/065* (2013.01); *H01Q 21/24* (2013.01)

(58) Field of Classification Search
CPC .... H01Q 21/24; H01Q 21/065; H01Q 9/0421; H01Q 1/243
See application file for complete search history.

(56) References Cited

U.S. PATENT DOCUMENTS

2017/0317421 A1* 11/2017 Grando ..... H01Q 15/006
2017/0317422 A1* 11/2017 Grando ..... H01P 5/10

* cited by examiner

*Primary Examiner* — Graham P Smith
(74) *Attorney, Agent, or Firm* — Oliff PLC

(57) ABSTRACT

A 5G MMW dual-polarized antenna unit, an antenna array and a terminal device are disclosed. The 5G MMW dual-polarized antenna unit comprises a substrate and two feeder assemblies disposed in the substrate, wherein a square radiation patch conductive with the feeder assemblies is disposed on a top surface of the substrate, and a ground layer and feeder ports conductive with the feeder assemblies are disposed on a bottom surface of the substrate; each feeder assembly comprises an impedance transformation micro-strip line, and the two impedance transformation micro-strip lines are perpendicular to each other; and a short-circuit structure allowing the radiation patch to be conductive with the ground layer is disposed in the substrate and is located an intersection of extension lines of the two impedance transformation micro-strip lines. The 5G MMW dual-polarized antenna unit effectively improves the antenna performance and satisfies application requirements of 5G communication terminals in this waveband.

20 Claims, 9 Drawing Sheets

5G MMW DUAL-POLARIZED ANTENNA UNIT, ANTENNA ARRAY AND TERMINAL DEVICE

TECHNICAL FIELD

The invention relates to the technical field of antennas, in particular to a 5G MMW dual-polarized antenna unit, an antenna array and a terminal device.

DESCRIPTION OF RELATED ART

The $5^{th}$ mobile communication (5G) technology is about to be commercially used, and covers a sub-6 GHz band and a MMW band for communication. Wherein, the MMW band with abundant spectrum resources can greatly increase the communication rate and has the advantage of low delay. Compared with a low frequency band which has been widely used previously, the MMW transmission distance is short due to a large path loss of MMW transmission, and multiple antenna units have to be assembled to form an array to improve the gain. However, a high gain will narrow the beams of antennas. In order to broaden the coverage of the antennas, the beam forming technology has been used.

Patch antennas have been widely used because of their simple structure. To improve the bandwidth, thick dielectrics are adopted generally. However, the thick dielectrics result in surface waves which may compromise the performance of the antennas. Particularly, the surface waves have a great influence on the scanning performance of an antenna array formed by the patch antennas. In addition, existing 5G MMW dual-polarized antenna units have the problem of polarization isolation deviations.

BRIEF SUMMARY OF THE INVENTION

The technical issue to be settled by the invention is to provide a 5G MMW dual-polarized high-performance antenna, an antenna array and a terminal device.

A first technical solution adopted by the invention to solve the aforesaid technical problems is as follows: a 5G MMW dual-polarized antenna unit comprises a substrate and two feeder assemblies disposed in the substrate, wherein a square radiation patch conductive with the feeder assemblies is disposed on a top surface of the substrate, and a ground layer and feeder ports conductive with the feeder assemblies are disposed on a bottom surface of the substrate; each feeder assembly comprises an impedance transformation micro-strip line, and the two impedance transformation micro-strip lines are perpendicular to each other; and a short-circuit structure allowing the radiation patch to be conductive with the ground layer is disposed in the substrate and is located at an intersection of extension lines of the two impedance transformation micro-stripe lines.

A second technical solution adopted by the invention to solve the aforesaid technical problems is as follows: an antenna array comprises the 5G MMW dual-polarized antenna unit.

A third technical solution adopted by the invention to solve the aforesaid technical problems is as follows: a terminal device comprises the antenna array.

The invention has the following beneficial effects: the short-circuit structure is disposed in the 5G MMW dual-polarized antenna unit, so that the antenna bandwidth is broadened, the polarization isolation is improved, and the antenna performance is effectively improved. The 5G MMW dual-polarized antenna unit and the antenna array can effectively cover the N257 (from 26.5 GHz to 29.5 GHz) waveband and satisfy the application requirements of 5G communication terminals in this waveband. In addition, the thickness of the substrate of the 5G MMW dual-polarized antenna unit can be made very small to weaken surface waves of the substrate, thus further improving the antenna performance.

REFERENCE SIGNS

Figure 1:
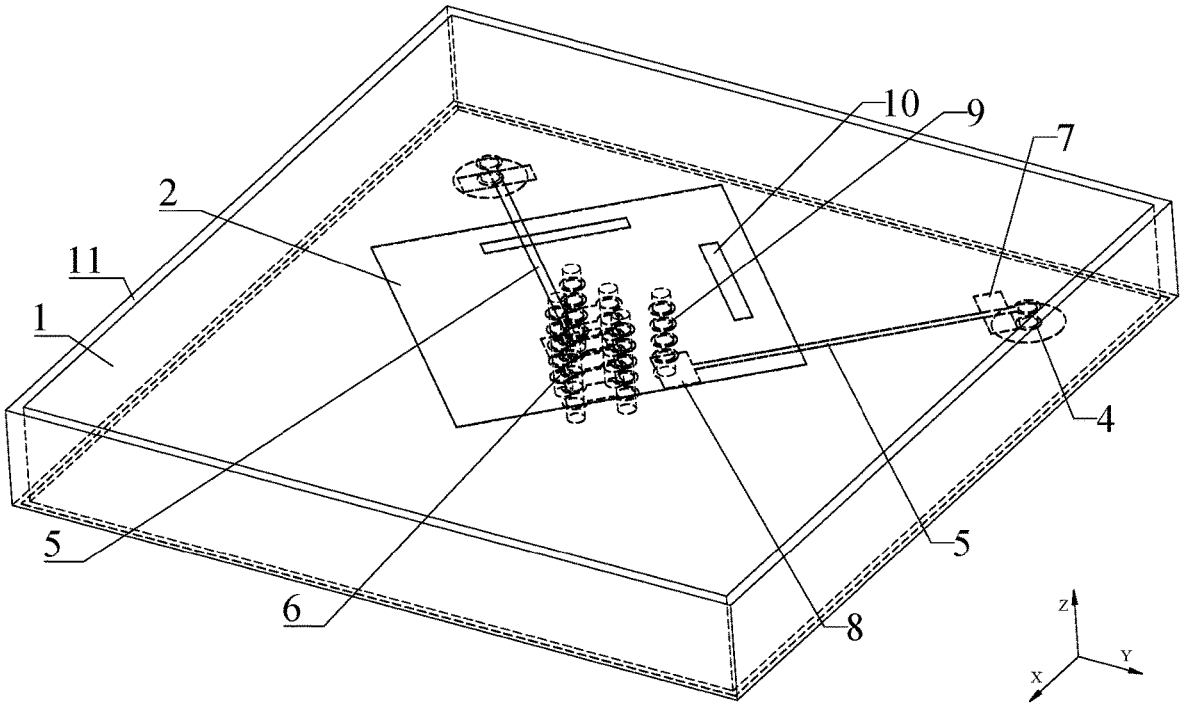
FIG. 1 is a structural view of a 5G MMW dual-polarized antenna unit in Embodiment 1 of the invention.

1, substrate; 2, radiation patch; 3, ground layer; 4, feeder port; 5, impedance transformation micro-strip line; 6, short-circuit structure; 7, first matching branch; 8, second matching branch; 9, feeder pillar; 10, slot; 11, isolation wall; 12, window; 13, chip.

DETAILED DESCRIPTION OF THE INVENTION

The technical contents, purposes and effects of the invention are described in detail below in conjunction with the embodiments and accompanying drawings.

Referring to FIG. 1 to FIG. 17, a 5G MMW dual-polarized antenna unit comprises a substrate 1 and two feeder assemblies disposed in the substrate 1, wherein a square radiation patch 2 conductive with the feeder assemblies is disposed on a top surface of the substrate 1, a ground layer 3, and feeder ports 4 conductive with the feeder assemblies are disposed on a bottom surface of the substrate 1. Each feeder assembly comprises an impedance transformation micro-strip line 5. The two impedance transformation micro-strip lines 5 are perpendicular to each other. A short-circuit structure 6 allowing the radiation patch 2 to be conductive with the ground layer 3 is disposed in the substrate 1 and is located at an intersection of extension lines of the two impedance transformation micro-strip lines 5.

From the above description, the invention has the following beneficial effects: the short-circuit structure 6 is disposed in the 5G MMW dual-polarized antenna unit, so that the antenna bandwidth is broadened, the polarization insulation is improved, and the antenna performance is effectively improved; the 5G MMW dual-polarized antenna unit and the antenna array can effectively cover the N257 waveband (from 26.5 GHz to 29.5 GHz) and satisfy the application requirements of 5G communication terminal devices in this waveband; in addition, the thickness of the substrate 1 in the 5G MMW dual-polarized antenna unit can be very small to weaken surface waves of the substrate 1, thus further improving the antenna performance.

Furthermore, each feeder assembly further comprises a first matching branch 7, a second matching branch 8 and a feeder pillar 9, wherein the first matching branch 7 conductive with the feeder port 4 is disposed at one end of the impedance transformation micro-strip line 5, the other end of the impedance transformation micro-strip line 5 is connected to one end of the feeder pillar 9, and the other end of the feeder pillar 9 is connected to the radiation patch 2.

From the above description, the feeder assembly is simple in structure and easy to machine; the first matching branch and the second matching branch are mainly used to improve the compatibility of antennas and neutralize the sensitivity of the antennas, and the compatibility of the antennas can be improved by increasing the length or width of the first matching branch and the second matching branch. The impedance at the feeder port 4 can reach 50 ohm through the collaboration of the first/second matching branch and the impedance transformation micro-strip line 5.

Furthermore, slots 10 corresponding to the impedance transformation micro-strip lines 5 are formed in the radiation patch 2 and are perpendicular to the impedance transformation micro-strip lines 5.

From the above description, the slots 10 are mainly used to control and match the isolation of the feeder ports 4 and have some influence on the operating frequency.

Furthermore, the two impedance transformation micro-strip lines 5 are disposed along two diagonal lines of the radiation patch 2 respectively; or, the two impedance transformation micro-strip lines 5 are disposed perpendicular to two edge lines of the radiation patch 2 respectively.

Furthermore, a projective contour of the substrate 1 in a vertical direction is square, and the two impedance transformation micro-strip lines 5 are disposed along two diagonal lines of the projective contour respectively; or, the two impedance transformation micro-strip lines 5 are disposed perpendicular to two edge lines of the projective contour respectively.

From the above description, the 5G MMW dual-polarized antenna unit has at least four above-mentioned configurations, which include horizontal/vertical polarization and ±45° polarization. The 5G MMW dual-polarized antenna unit has different specific configurations that can be selected by users as required.

Furthermore, an isolation wall 11 is disposed on the periphery of the substrate 1.

From the above description, the isolation wall 11 can improve the isolation between different units, thus further improving the performance of the antenna unit.

Furthermore, a window 12 is disposed on the isolation wall 11.

From the above description, when multiple 5G MMW dual-polarized antenna units are assembled to form an antenna array, the window 12 on the isolation wall 11 can improve the matching degree of the antenna array when the antenna array scans a large angle, thus improving the performance of the antenna array.

Furthermore, the substrate 1 is made of low-temperature co-fired ceramic or a multi-layered circuit board.

From the above description, the substrate 1 made of the low-temperature co-fired ceramic or the multi-layered circuit board is beneficial to the integration of the 5G MMW dual-polarized antenna unit and a chip 13 and can reduce the production cost. In addition, the substrate 1 made of the low-temperature co-fired ceramic or the multi-layered circuit board is also beneficial to the arrangement of the feeder assemblies and can lower the machining difficulty.

An antenna array comprises the 5G MMW dual-polarized antenna unit.

From the above description, the antenna array has broad beam coverage and good performance.

A terminal device comprises the antenna array.

From the above description, the terminal device provided with multiple antenna arrays can fulfill multidirectional coverage.

Embodiment 1

Figure 2:
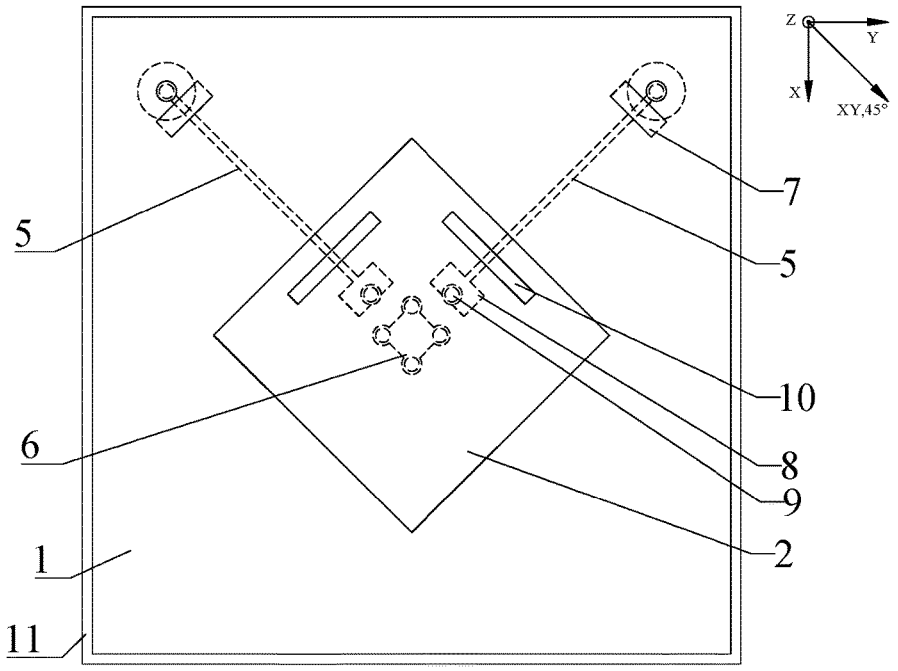
FIG. 2 is a top view of the 5G MMW dual-polarized antenna unit in Embodiment 1 of the invention.
Figure 3:
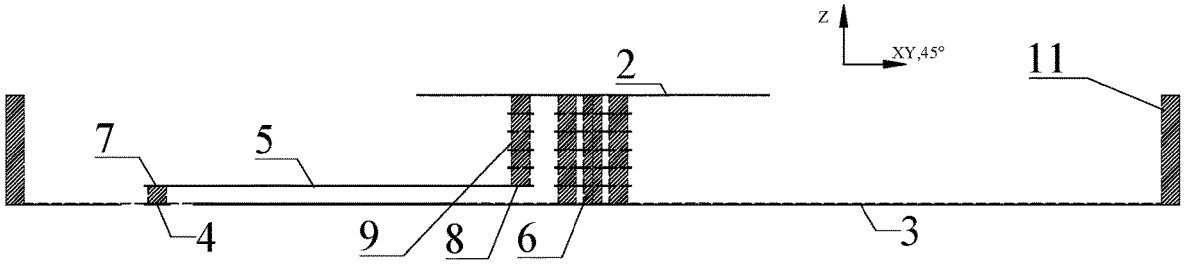
FIG. 3 is a sectional view of the 5G MMW dual-polarized antenna unit in Embodiment 1 of the invention.

Referring to FIG. 1 to FIG. 17, Embodiment 1 of the invention is as follows: as shown in FIG. 1 to FIG. 3, a 5G MMW dual-polarized antenna unit comprises a substrate 1 and two feeder assemblies disposed in the substrate 1, wherein a square radiation patch 2 conductive with the feeder assemblies is disposed on a top surface of the substrate 1, and a ground layer 3 and feeder ports 4 conductive with the feeder assemblies are disposed on a bottom surface of the substrate 1. Specifically, the ground layer 3 has two uncovered regions, and the feeder ports 4 are disposed in the uncovered regions to be prevented from being conductive with the ground layer 3. In this embodiment, the projective contour of the substrate 1 in a vertical direction is square. Furthermore, the substrate 1 is made of low-temperature co-fired ceramic or a multi-layer circuit board.

Each feeder assembly comprises an impedance transformation micro-strip line 5. The two impedance transformation micro-strip lines 5 are perpendicular to each other. A short-circuit structure 6 allowing the radiation patch 2 to be conductive with the ground layer 3 is disposed in the substrate 1 and is located at an intersection of extension lines of the two impedance transformation micro-strip lines 5. Preferably, a joint of the short-circuit structure 6 and the radiation patch 2 is located at the center of the radiation patch 2. Specifically, each feeder assembly further comprises a first matching branch 7, a second matching branch 8 and a feeder pillar 9, wherein the first matching branch 7 conductive with the feeder port 4 is disposed at one end of the impedance transformation micro-strip line 5, the other end of the impedance transformation micro-strip line 5 is connected to one end of the feeder pillar 9, and the other end of the feeder pillar 9 is connected to the radiation patch 2;

the feeder pillar 9 is a probe structure, a metalized hole structure, or hole-filled structure.

Optionally, slots 10 corresponding to the impedance transformation micro-strip lines 5 are formed in the radiation patch 2 and are perpendicular to the impedance transformation micro-strip lines 5. In this embodiment, the slots 10 are linear and stretch across two sides of the impedance transformation micro-strip lines 5. It should be noted that the slots 10 may not be configured in other embodiments.

Figure 4:
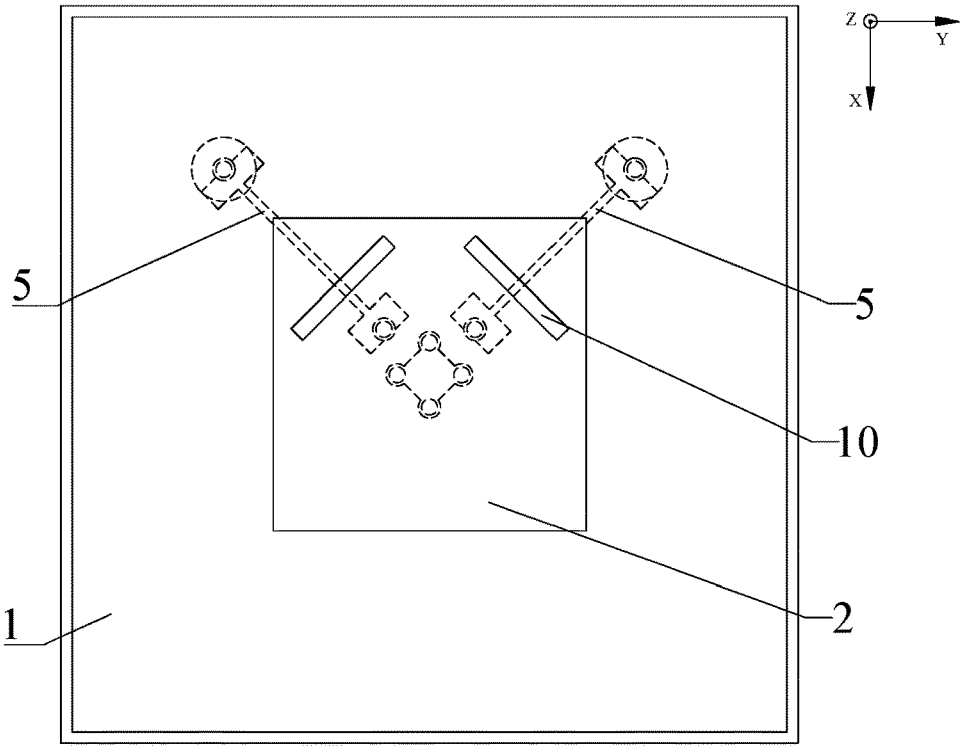
FIG. 4 is a structural view of the 5G MMW dual-polarized antenna unit of another structure of the invention.
Figure 5:
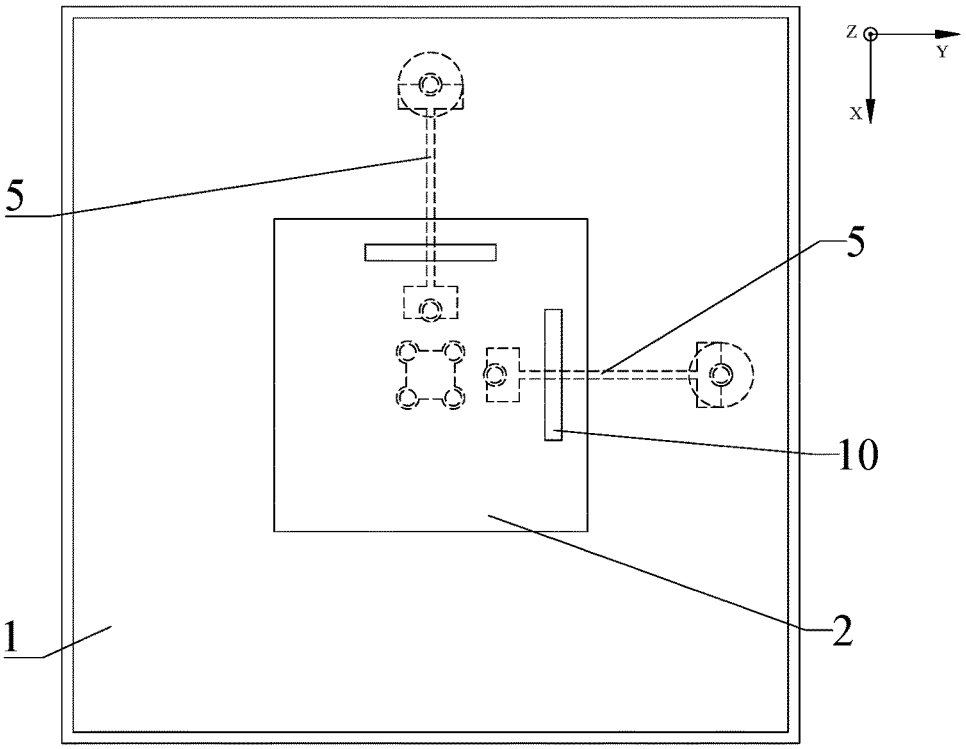
FIG. 5 is a structural view of the 5G MMW dual-polarized antenna unit of another structure of the invention.
Figure 6:
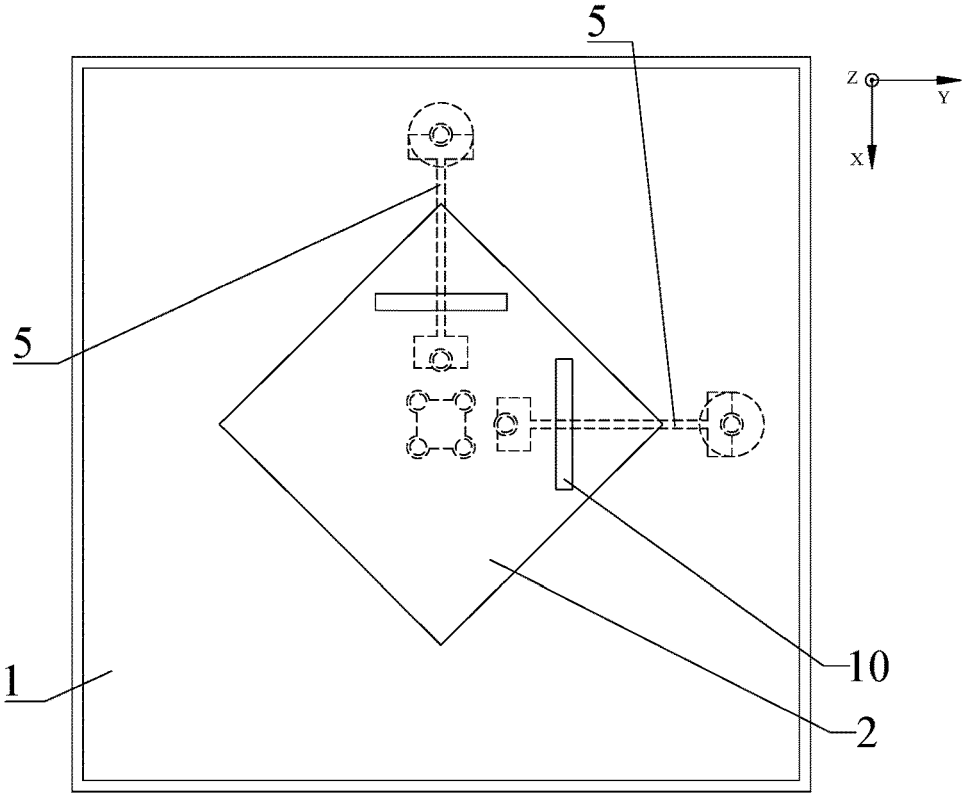
FIG. 6 is a structural view of the 5G MMW dual-polarized antenna unit of another structure of the invention.

In this embodiment, the two impedance transformation micro-strip lines 5 are disposed perpendicular to two edge lines of the radiation patch 2 and along two diagonal lines of the projective contour respectively, that is, the two feeder pillars 9 of the 5G MMW dual-polarized antenna unit excite ±45° polarization of an antenna respectively. It can be understood that in this case, the lengthwise direction of the slots 10 is identical with the edge length direction of the radiation patch 2. As shown in FIG. 4, in another embodiment, the two impedance transformation micro-strip lines 5 are disposed along two diagonal lines of the radiation patch 2 and along two diagonal lines of the projective contour respectively, and in this case, the two feeder pillars 9 of the 5G MMW dual-polarized antenna unit excite ±45° polarization of the antenna respectively. As shown in FIG. 5, in another embodiment, the two impedance transformation micro-strip lines 5 are disposed perpendicular to two edge lines of the radiation patch 2 and perpendicular to two edge lines of the projective contour respectively, and in this case, the two feeder pillars 9 of the 5G MMW dual-polarized antenna unit excite vertical polarization and horizontal polarization of the antenna respectively. As shown in FIG. 6, in another embodiment, the two impedance transformation micro-strip lines 5 are disposed along two diagonal lines of the radiation patch 2 and perpendicular to two edge lines of the projective contour respectively, and in this case, the two feeder pillars 9 of the 5G MMW dual-polarized antenna unit excite vertical polarization and horizontal polarization of the antenna respectively. Thus it can be seen that the 5G MMW dual-polarized antenna unit can be applied to vertical and horizontal dual-polarized antennas as well as ±45° dual-polarized antennas.

Referring to FIG. 1 to FIG. 3, optionally, the short-circuit structure 6 is formed by short-circuit pillars. In this embodiment, the short-circuit structure 6 includes four short-circuit pillars which are mutually conductive and are arranged in a rectangular shape to form a rectangular body, and the impedance transformation micro-strip lines 5 are disposed perpendicular to side edges of the rectangular body.

Furthermore, an isolation wall 11 is arranged on the periphery of the substrate 1 to improve the isolation between the 5G MMW dual-polarized antenna units, thus improving the performance of the antenna.

Referring to FIG. 10 to FIG. 12 and FIG. 15, this embodiment further provides an antenna array. The antenna array comprises multiple 5G MMW dual-polarized antenna units which are arranged in one row, and the antenna array can fulfill beam scanning by adjusting feed phases of the 5G MMW dual-polarized antenna units. Specifically, the antenna array may be integrated with a chip 13 in a flip chip manner, and a phase shifter in the chip 13 can provide phase differences for the 5G MMW dual-polarized antenna units to fulfill beam forming.

To help the readers have a better understanding of this technical solution, the applicant offers a more detailed explanation with a 5G MMW dual-polarized antenna unit covering an N257 (from 26.5 GHz to 29.5 GHz) waveband as an example. The radiation patch 2, the short-circuit pillars, the feeder pillars 9, the first matching branches 7, the impedance transformation micro-strip lines 5, the second matching branches 8, the ground layer 3 and the isolation wall 11 are all metal/metalized structures. To cover the N257 waveband, the thickness of the substrate 1 is about 6% of the dielectric wavelength. The edge length of the radiation patch 2 is about half of the dielectric wavelength under the operating frequency of the antenna, that is, the dielectric constant of the substrate 1 is 6, the edge length of the radiation patch 2 within the N257 waveband is about 2.2 mm, and the center of the radiation patch 2 is connected to the ground layer 3 through the short-circuit pillars.

Figure 7:
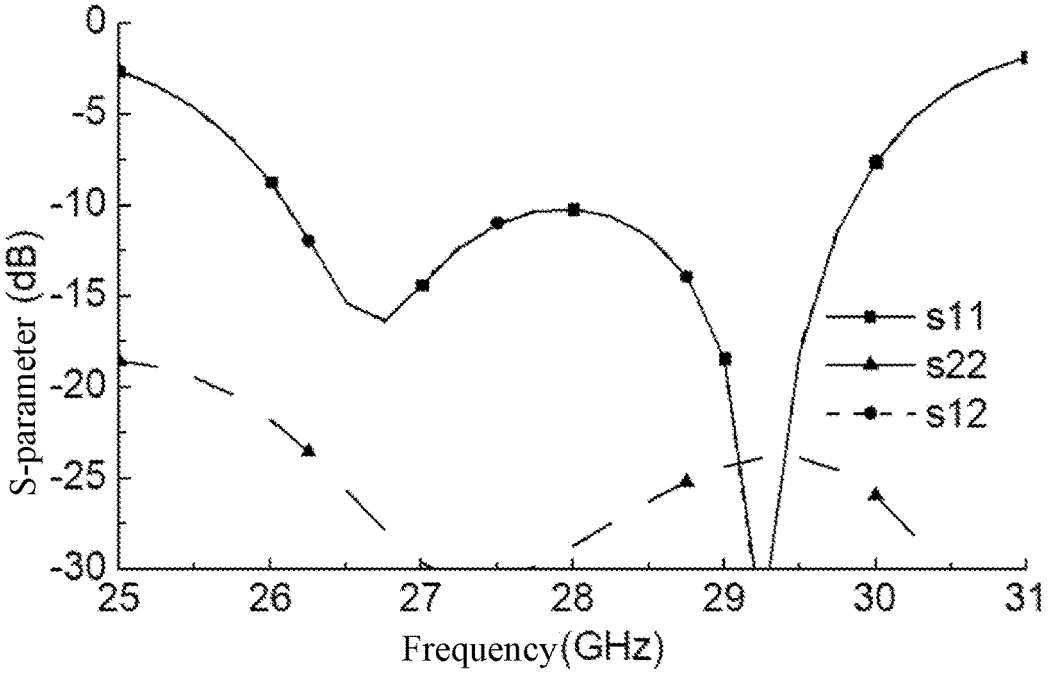
FIG. 7 is an s-parameter diagram of the 5G MMW dual-polarized antenna unit in Embodiment 1 of the invention.
Figure 8:
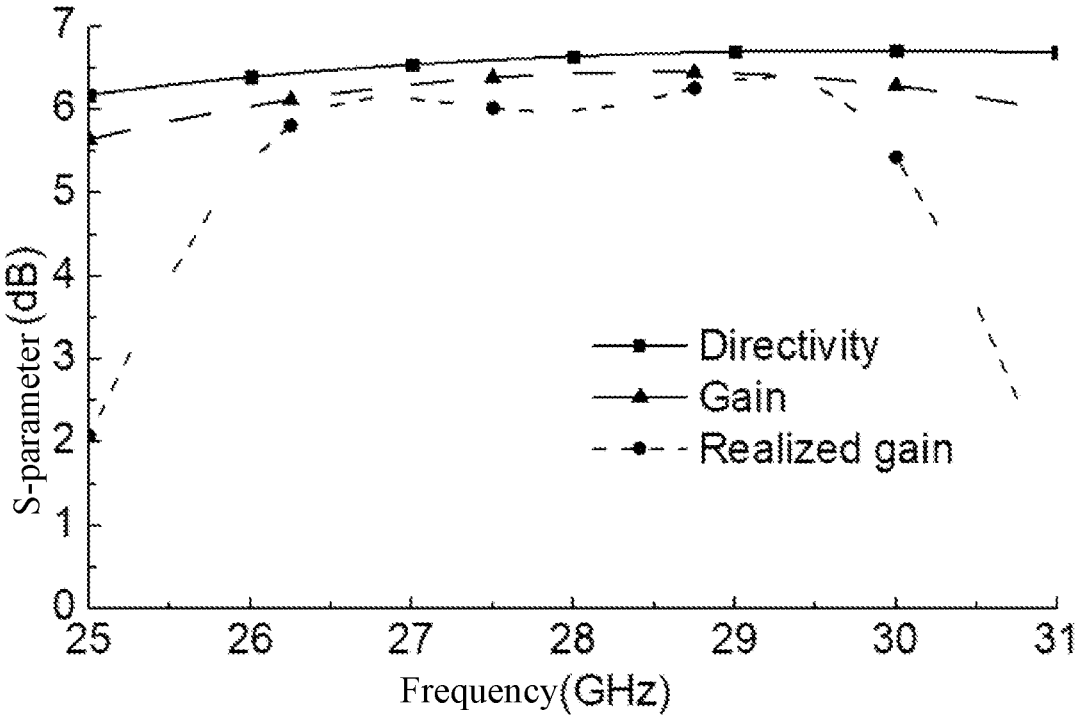
FIG. 8 is a gain simulation result diagram of the 5G MMW dual-polarized antenna unit in Embodiment 1 of the invention.
Figure 9:
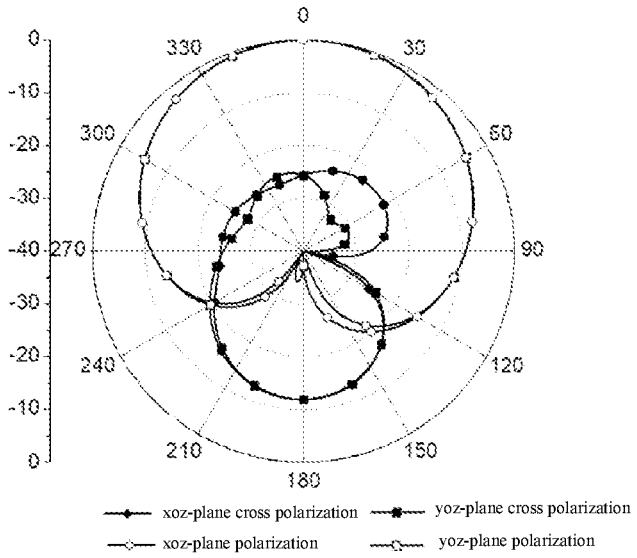
FIG. 9 is a radiation direction simulation result diagram of the 5G MMW dual-polarized antenna unit in Embodiment 1 of the invention.

FIG. 7 to FIG. 9 are performance simulation result diagrams of the 5G MMW dual-polarized antenna unit covering the N257 waveband. Wherein the substrate 1 is made of RO4350, and the outline dimension of the 5G MMW dual-polarized antenna unit is 4.5 mm*4.5 mm*0.65 mm. As shown in FIG. 7, the 5G MMW dual-polarized antenna unit with a reflection coefficient less than −10 dB has a bandwidth ranging from 26.2 GHz to 29.8 GHz and covers the N257 waveband, and the isolation of the two feeder ports 4 is greater than 22 dB. FIG. 8 illustrates the gain of the 5G MMW dual-polarized antenna unit. As can be seen from FIG. 8, the gain of the 5G MMW dual-polarized antenna unit within this bandwidth is 5.6-6.4 dBi. FIG. 9 illustrates a direction diagram of the 5G MMW dual-polarized antenna unit. As can be seen from FIG. 9, the 5G MMW dual-polarized antenna unit can realize directional radiation and good cross polarization.

Figure 10:
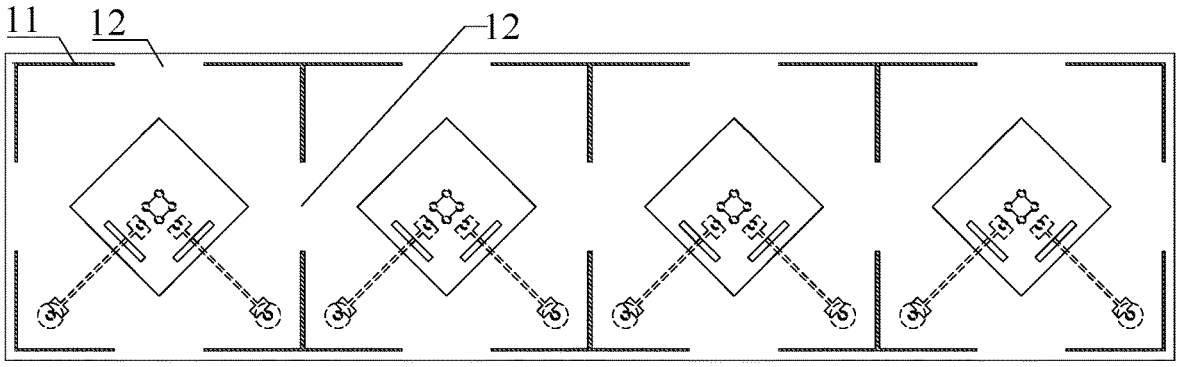
FIG. 10 is a top view of an antenna array of the invention.
Figure 11:
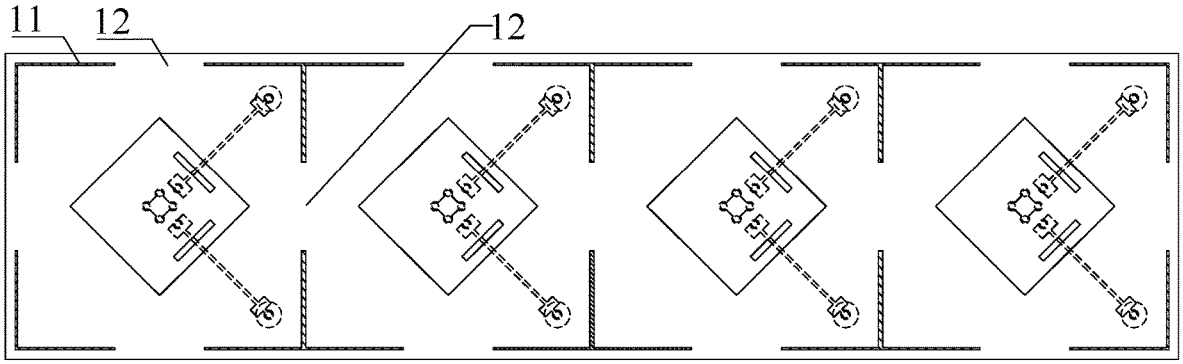
FIG. 11 is a top view of an antenna array in Embodiment 1 of the invention.
Figure 12:
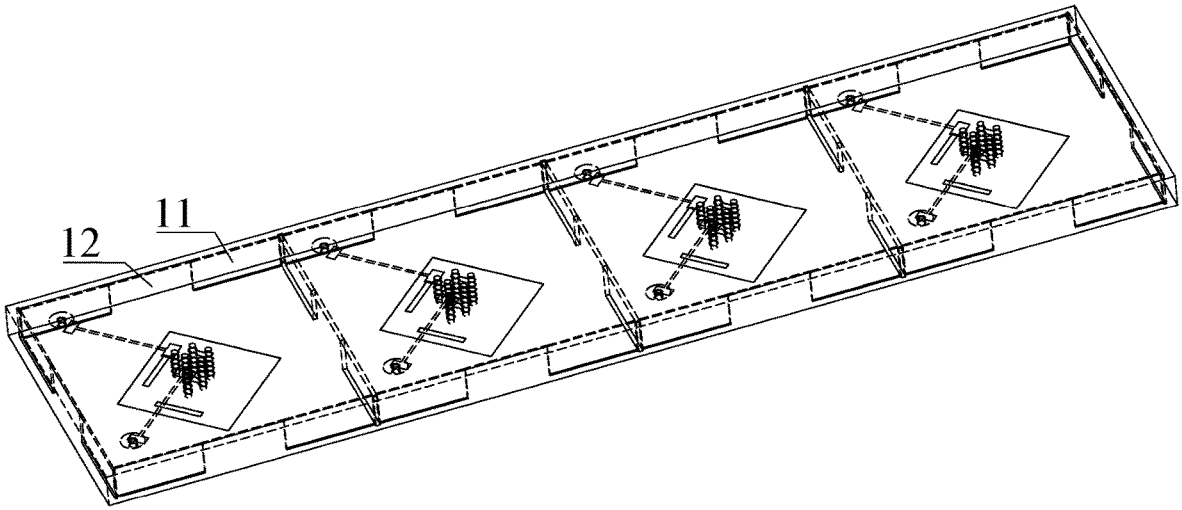
FIG. 12 is a perspective view of the antenna array in Embodiment 1 of the invention.
Figure 13:
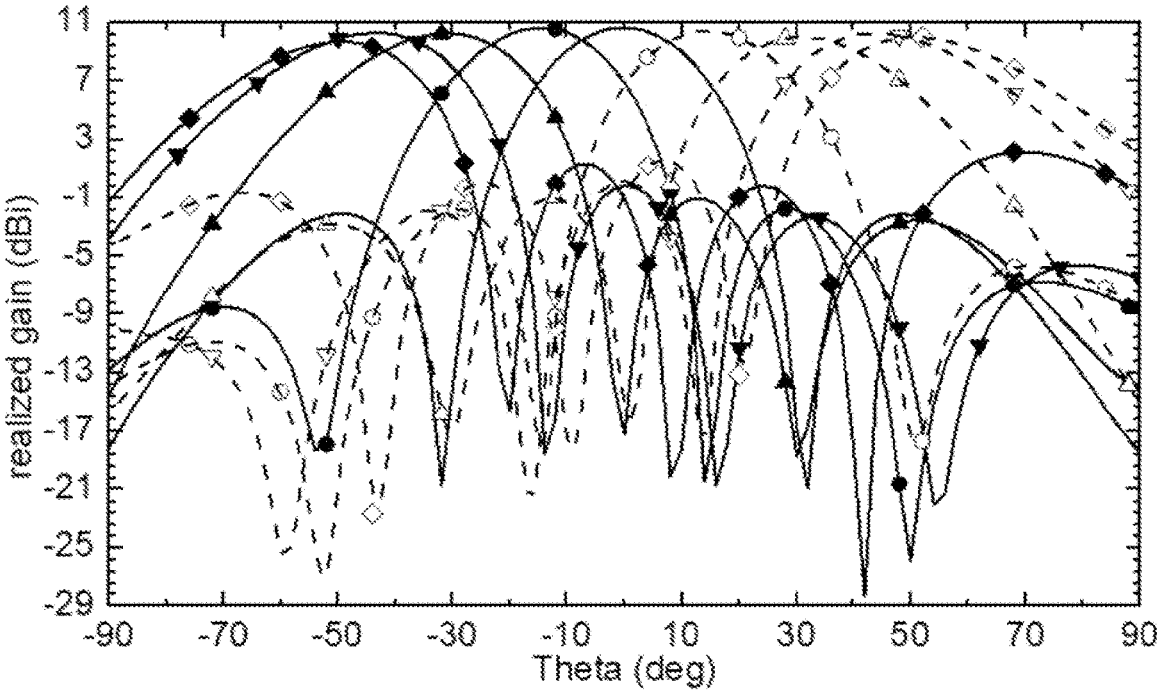
FIG. 13 is a radiation direction simulation result diagram of the antenna array in Embodiment 1 of the invention.
Figure 14:
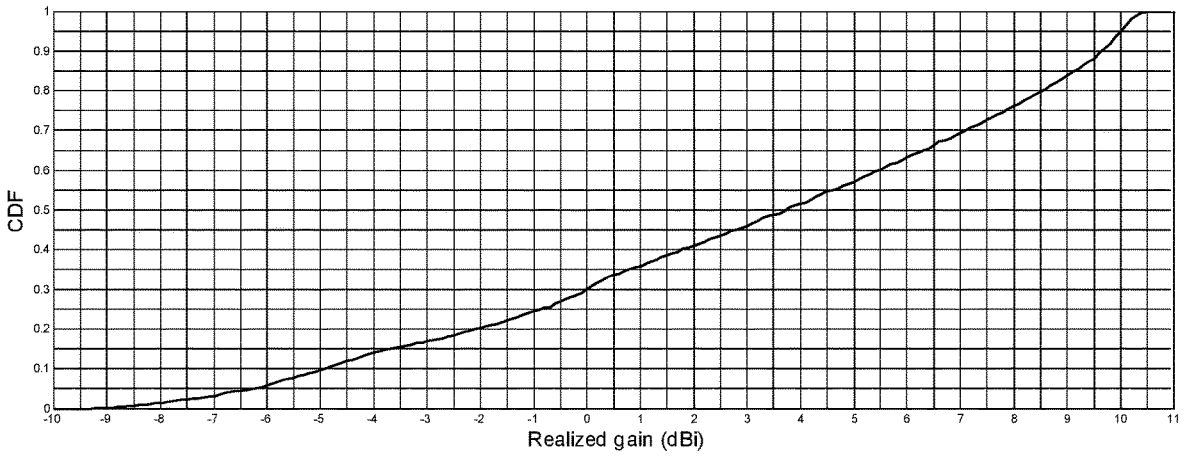
FIG. 14 is a CDP simulation result diagram of the antenna array in Embodiment 1 of the invention.
Figure 15:
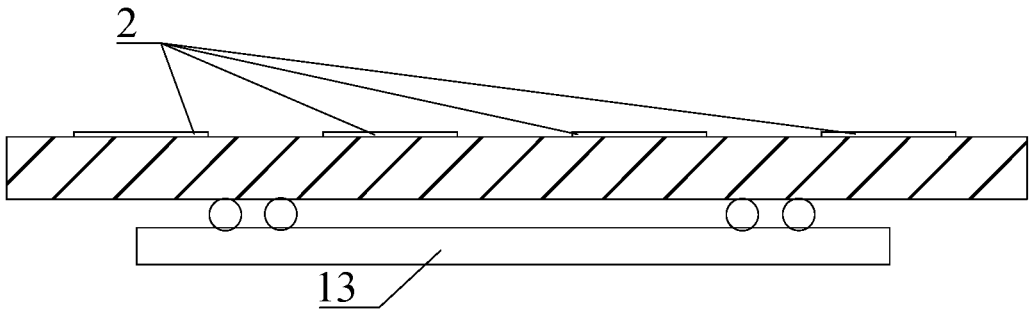
FIG. 15 is an integration diagram of the antenna array and a chip in Embodiment 1 of the invention.

As illustrated in FIG. 10 to FIG. 12, an antenna array is formed by four 5G MMW dual-polarized antenna units. FIG. 10 and FIG. 11 illustrate two different configurations, and FIG. 12 is a 3D diagram of the configuration in FIG. 11. The center distance between every two adjacent 5G MMW dual-polarized antenna units within the N257 waveband is about 4.5 mm-5 mm According to different design requirements, when operating within the N257 waveband, the entire antenna array has a length of about 17-20 mm and a width of about 4.4-5 mm. As illustrated, compared with the 5G MMW dual-polarized antenna unit, a window 12 is formed in the isolation wall 11 in the antenna array, so that the matching degree of the antenna array can be improved when the antenna array scans a large angle. FIG. 13 illustrates the scanning performance of the antenna array. As illustrated, the maximum gain of the antenna array is 10.4 dBi, and if the threshold is set to 7 dBi, the beam coverage of the antenna array is ±70°. FIG. 14 illustrates a CDF simulation result diagram of the antenna array. As can be seen from FIG. 10, if the threshold is set to 7 dBi, the CDF value is 0.7, which means that the gain of the antenna array in a 30% space is greater than 7 dBi. Thus, the antenna array has good antenna performance. FIG. 15 illustrates an integration diagram of the antenna array and the chip 13.

Figure 16:
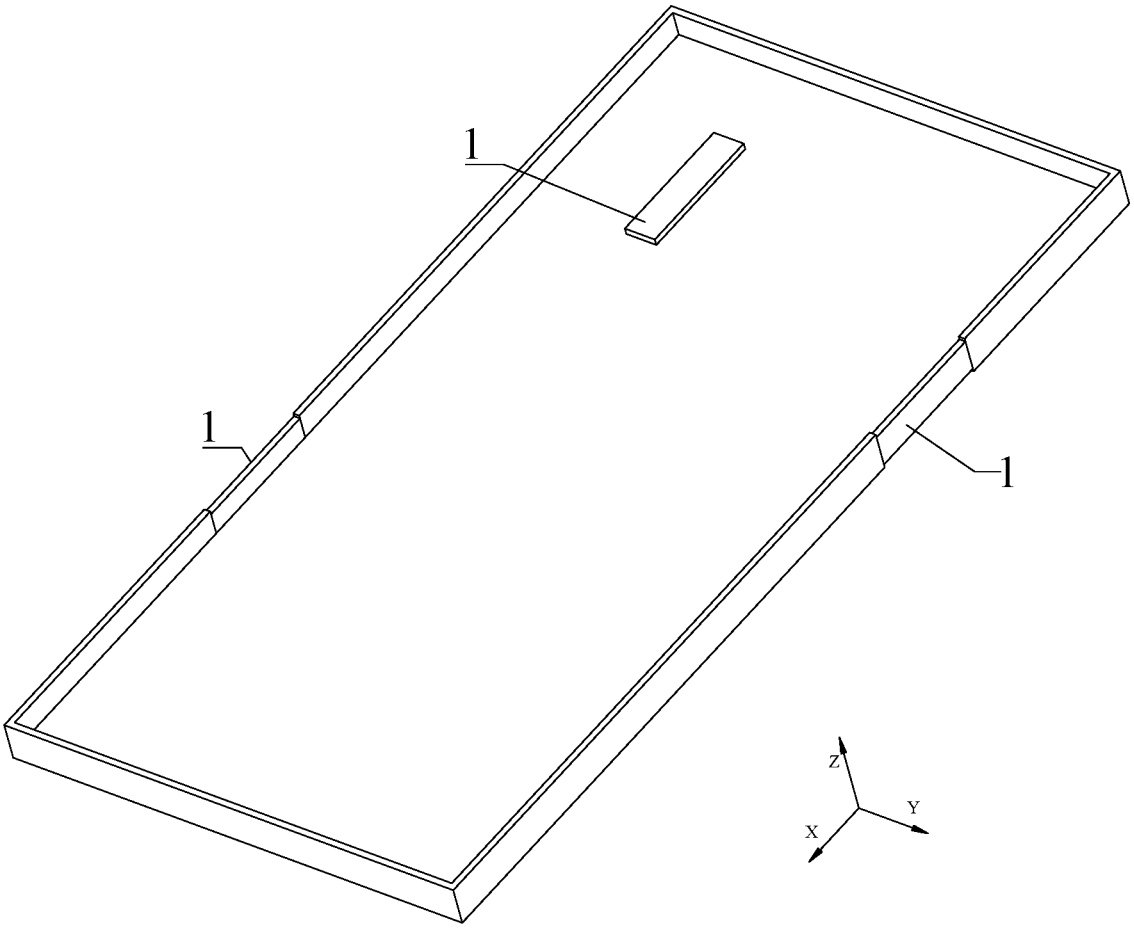
FIG. 16 is a structural view of a terminal device in Embodiment 1 of the invention.

As shown in FIG. 16, this embodiment further provides a terminal device. The terminal device comprises at least one antenna array. In this embodiment, the number of the antenna arrays is three, wherein one antenna array is disposed on a left border of the terminal device in a negative direction of the Y-axis, another antenna array is disposed on a right border of the terminal device in a positive direction of the Y-axis, and the other antenna array is disposed on the back of the terminal device in a positive direction of the Z-axis. Thus, the terminal device realizes multidirectional coverage.

Figure 17:
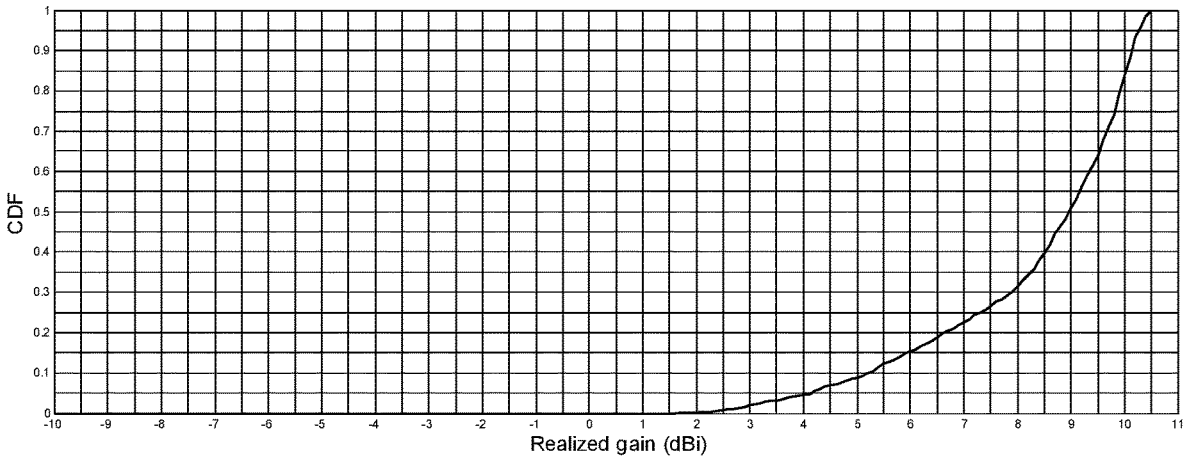
FIG. 17 is a CDF simulation result diagram of an antenna system in the terminal device in Embodiment 1 of the invention.

FIG. 17 illustrates a CDF simulation result diagram of an antenna system of the terminal device. As can be seen from FIG. 17, the antenna system of the terminal device can realize a gain over 7 dBi in a 78% space and can realize a gain over 5 dBi in a 92% space.

To sum up, the 5G MMW dual-polarized antenna unit, the antenna unit and the terminal device provided by the invention have a broad bandwidth, can cover the N257 (from 26.5 GHz to 29.5 GHz) waveband, and can satisfy the application requirements of 5G communication terminal devices in this waveband; the polarization isolation is high, and the antenna performance is good; the substrate is made of low-temperature co-fired ceramic or a multi-layer board, thus having a small thickness, reducing surface waves, further improving the antenna performance, and facilitating subsequent integration with a chip; and the antenna performance can be adjusted through the first/second matching branches and the slots, so that debugging is convenient.

The above embodiments are merely illustrated ones of the invention, and are not intended to limit the patent scope of the invention. All equivalent transformations made according to the contents of the specification and the accompanying drawings, or direct/indirect applications to relating technical fields should also fall within the patent protection scope of the invention.

The invention claimed is:

1. A 5G MMW dual-polarized antenna unit, comprising a substrate and two feeder assemblies disposed in the substrate, a square radiation patch conductive with the feeder assemblies being disposed on a top surface of the substrate, a ground layer and feeder ports conductive with the feeder assemblies being disposed on a bottom surface of the substrate, wherein each said feeder assembly comprises an impedance transformation micro-strip line, the two impedance transformation micro-strip lines are perpendicular to each other, and a short-circuit structure allowing the radiation patch to be conductive with the ground layer is disposed in the substrate and is located an intersection of extension lines of the two impedance transformation micro-strip lines.

2. The 5G MMW dual-polarized antenna unit according to claim 1, wherein each said feeder assembly further comprises a first matching branch, a second matching branch and a feeder pillar, the first matching branch conductive with the feeder port is disposed at one end of the impedance transformation micro-strip line, another end of the impedance transformation micro-strip line is connected to one end of the feeder pillar, and another end of the feeder pillar is connected to the radiation patch.

3. The 5G MMW dual-polarized antenna unit according to claim 1, wherein slots corresponding to the impedance transformation micro-strip lines are formed in the radiation patch and are perpendicular to the impedance transformation micro-strip lines.

4. The 5G MMW dual-polarized antenna unit according to claim 1, wherein the two impedance transformation micro-strip lines are disposed along two diagonal lines of the radiation patch respectively; or, the two impedance transformation micro-strip lines are disposed perpendicular to two edge lines of the radiation patch respectively.

5. The 5G MMW dual-polarized antenna unit according to claim 1, wherein a projective contour of the substrate in a vertical direction is square, and the two impedance transformation micro-strip lines are disposed along two diagonal lines of the projective contour respectively; or, the two impedance transformation micro-strip lines are disposed perpendicular to two edge lines of the projective contour respectively.

6. The 5G MMW dual-polarized antenna unit according to claim 1, wherein an isolation wall is disposed on a periphery of the substrate.

7. The 5G MMW dual-polarized antenna unit according to claim 6, wherein a window is disposed on the isolation wall.

8. The 5G MMW dual-polarized antenna unit according to claim 1, wherein the substrate is made of low-temperature co-fired ceramic or a multi-layer circuit board.

9. An antenna array, comprising a 5G MMW dual-polarized antenna unit, wherein the 5G MMW dual-polarized antenna unit comprises a substrate and two feeder assemblies disposed in the substrate, a square radiation patch conductive with the feeder assemblies is disposed on a top surface of the substrate, a ground layer and feeder ports conductive with the feeder assemblies are disposed on a bottom surface of the substrate, each said feeder assembly comprises an impedance transformation micro-strip line, the two impedance transformation micro-strip lines are perpendicular to each other, and a short-circuit structure allowing the radiation patch to be conductive with the ground layer is disposed in the substrate and is located an intersection of extension lines of the two impedance transformation micro-strip lines.

10. The antenna array according to claim 9, wherein each said feeder assembly further comprises a first matching branch, a second matching branch and a feeder pillar, the first matching branch conductive with the feeder port is disposed at one end of the impedance transformation micro-strip line, another end of the impedance transformation micro-strip line is connected to one end of the feeder pillar, and another end of the feeder pillar is connected to the radiation patch.

11. The antenna array according to claim 9, wherein slots corresponding to the impedance transformation micro-strip lines are formed in the radiation patch and are perpendicular to the impedance transformation micro-strip lines.

12. The antenna array according to claim 9, wherein the two impedance transformation micro-strip lines are disposed along two diagonal lines of the radiation patch respectively; or, the two impedance transformation micro-strip lines are disposed perpendicular to two edge lines of the radiation patch respectively.

13. The antenna array according to claim 9, wherein a projective contour of the substrate in a vertical direction is square, and the two impedance transformation micro-strip lines are disposed along two diagonal lines of the projective contour respectively; or, the two impedance transformation micro-strip lines are disposed perpendicular to two edge lines of the projective contour respectively.

14. The antenna array according to claim 9, wherein an isolation wall is disposed on a periphery of the substrate.

15. A terminal device, comprising an antenna array, wherein the antenna array comprises a 5G MMW dual-polarized antenna unit, the 5G MMW dual-polarized antenna unit comprises a substrate and two feeder assemblies disposed in the substrate, a square radiation patch conductive with the feeder assemblies is disposed on a top surface of the substrate, a ground layer and feeder ports conductive with the feeder assemblies are disposed on a bottom surface of the substrate, each said feeder assembly comprises an impedance transformation micro-strip line, the two impedance transformation micro-strip lines are perpendicular to each other, and a short-circuit structure conductive with the radiation patch and the ground layer is disposed in the substrate and is located an intersection of extension lines of the two impedance transformation micro-strip lines.

16. The terminal device according to claim 15, wherein each said feeder assembly further comprises a first matching branch, a second matching branch and a feeder pillar, the first matching branch conductive with the feeder port is disposed at one end of the impedance transformation micro-strip line, another end of the impedance transformation micro-strip line is connected to one end of the feeder pillar, and another end of the feeder pillar is connected to the radiation patch.

17. The terminal device according to claim 15, wherein slots corresponding to the impedance transformation micro-strip lines are formed in the radiation patch and are perpendicular to the impedance transformation micro-strip lines.

18. The terminal device according to claim 15, wherein the two impedance transformation micro-strip lines are disposed along two diagonal lines of the radiation patch respectively; or, the two impedance transformation micro-strip lines are disposed perpendicular to two edge lines of the radiation patch respectively.

19. The terminal device according to claim 15, wherein a projective contour of the substrate in a vertical direction is square, and the two impedance transformation micro-strip lines are disposed along two diagonal lines of the projective contour respectively; or, the two impedance transformation micro-strip lines are disposed perpendicular to two edge lines of the projective contour respectively.

20. The terminal device according to claim 15, wherein an isolation wall is disposed on a periphery of the substrate.

* * * * *